United States Patent [19]

Price

[11] Patent Number: 4,600,124

[45] Date of Patent: Jul. 15, 1986

[54] CONTROLLED TEMPERATURE HOT MELT ADHESIVE DISPENSING SYSTEM

[75] Inventor: Richard P. Price, Parma Heights, Ohio

[73] Assignee: Nordson Corporation, Amherst, Ohio

[21] Appl. No.: 731,933

[22] Filed: May 8, 1985

[51] Int. Cl.[4] ..... B67D 5/62

[52] U.S. Cl. ..... 222/54; 222/146.5; 219/230; 219/308; 219/486; 264/40.6; 425/143

[58] Field of Search ..... 222/54, 146.5; 264/40.6; 425/143; 219/230, 308, 486

[56] References Cited

U.S. PATENT DOCUMENTS

| | | | |
|---|---|---|---|
| 3,733,059 | 5/1973 | Pettit | 425/143 X |
| 4,094,940 | 6/1978 | Hold | 264/40.6 |
| 4,197,070 | 4/1980 | Koschmann | 264/40.6 |
| 4,272,466 | 6/1981 | Harris | 264/40.6 |

*Primary Examiner*—Charles A. Marmor
*Attorney, Agent, or Firm*—Wood, Herron & Evans

[57] ABSTRACT

A controlled temperature hot melt adhesive dispensing system including three closed loop temperature control arrangements along a flow path for hot melt adhesive extending from an upstream adhesive source to a downstream adhesive dispenser. As disclosed, each closed loop temperature control arrangement includes a comparator which compares the temperature sensed by a temperature sensor with a setpoint temperature to produce a control signal for a heater in the temperature control arrangement. The temperature control loops are located along the adhesive flow path so that the second closed loop temperature controller is upstream from the first closed loop temperature controller; and the third closed loop temperature controller is upstream from both the first and second temperature controllers. A first feedback circuit scales and integrates the control signal from the first location to produce a first feedback circuit output which adjusts the setpoint temperature at the second location. A second feedback circuit scales and integrates the control signal from the second location to produce a second feedback output which adjusts the third setpoint temperature. In this way, the three closed loop temperature control arrangements are cascaded so that the control signals developed are coupled, directly or indirectly, to each upstream closed loop temperature control arrangement.

4 Claims, 4 Drawing Figures

CONTROLLED TEMPERATURE HOT MELT ADHESIVE DISPENSING SYSTEM

DESCRIPTION OF THE INVENTION

Figure 1:
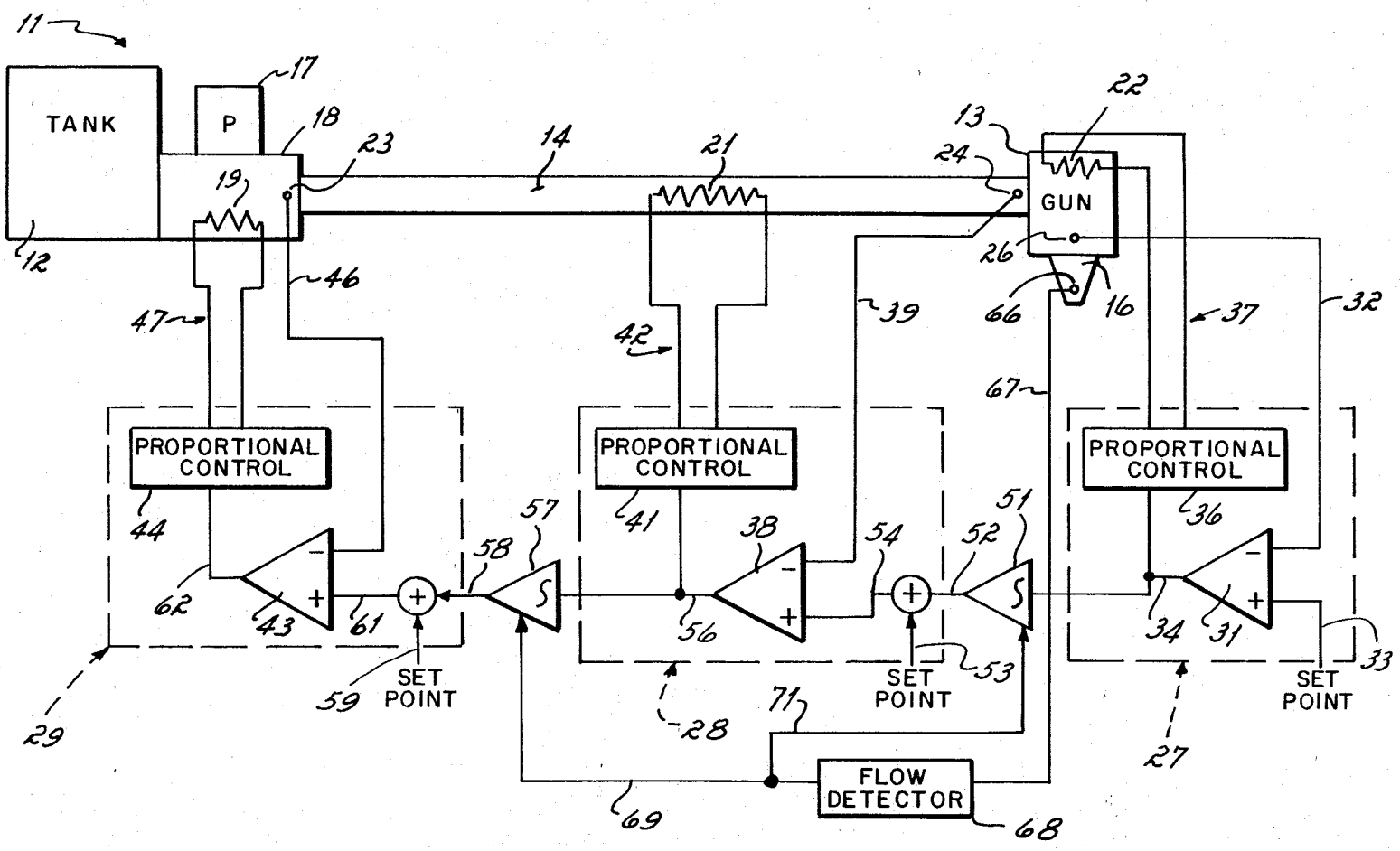

This invention relates generally to dispensing systems for heated fluids and more particularly concerns such a system including several controlled heaters along a flow path for fluid to be dispensed.

A number of industrial applications exist in which a heated liquid or molten solid or the like is moved through a flow path to an outlet. For example, in the extrusion of plastics, heated thermoplastic material is conveyed through a suitable conduit to an extruder, and in hot melt adhesive dispensing systems, molten adhesive is conveyed from an adhesive tank to a dispenser.

In the case of a hot melt adhesive dispensing system, for example, such a system typically includes a heated dispenser, or gun, receiving hot melt adhesive in a molten condition from a heated tank or manifold through a heated hose. In one form of such system, adhesive in solid form is melted in a tank and pumped from the tank via a heated manifold to the dispenser through the hose.

Heaters are employed in the hose and in the dispenser, as well as in the pump manifold, in order to prevent cooling, and resultant solidification, of the adhesive while it travels from the manifold to the dispenser outlet, or nozzle.

In the past, in such systems, the gun, the hose, and the manifold each served as separate locations along the hot melt adhesive flow path at which individual heaters under closed loop heater control were provided. Thus, in such a system, at the dispenser, a temperature sensor monitors the temperature of adhesive in the dispenser, and a heater controller compares the monitored temperature with a setpoint temperature to control a heater in the dispenser. Similar closed loop heater control is provided utilizing a separate heater and temperature sensor for each of the hose and the manifold. In such a system, it has proved difficult to maintain the discharge temperature of adhesive at the dispenser at a desired level. However, since the dispensed adhesive temperature affects the performance and the characteristics of the adhesive as it is applied to substrates, it is desirable to maintain this temperature as nearly as possible at a selected, substantially constant level.

It is the general aim of the invention in heated material flow systems of the foregoing type to provide an improved controlled temperature dispensing system in which the temperature of the dispensed material is much more nearly constant than has been possible in previous systems.

In one embodiment of the invention, the improved controlled temperature dispensing system takes the form of a hot melt adhesive dispensing system having a heated manifold, a heated dispenser, or gun, and a heated hose for coupling adhesive from the manifold to the dispenser. A closed loop temperature control arrangement is provided for each of these three system portions (the manifold, the hose and the gun) wherein the adhesive temperature is compared to a setpoint temperature to produce an error, or control, signal; and a heater is controlled based upon the error signal, which is reflective of the error between the actual temperature and the setpoint temperature.

In addition, in the illustrated form of the invention, the temperature error signal at the dispenser is scaled and integrated over time to produce a first feedback signal which is used to alter the hose setpoint temperature. Similarly, for adhesive in the hose, the error between the sensed temperature and an adjusted setpoint temperature is scaled and integrated over time to produce a second feedback signal for adjusting the setpoint temperature of the manifold closed loop temperature control arrangement. This "cascading" of the temperature error signals improves the uniformity of dispensed adhesive temperature by cascading the downstream (with reference to the direction of adhesive flow) temperature errors to upstream closed loop temperature control arrangements.

In practice, the dispenser and the dispenser heater in such a hot melt adhesive dispensing system, have a substantially limited heat transfer capability relative to that of the manifold and manifold heater. Usually, the hose heater is capable of transferring more heat to the adhesive than the dispenser heater, but less than that of the manifold heater. Therefore, the dispenser heater is capable, as adhesive flows through the system and is dispensed, of raising the temperature of dispensed adhesive only a relatively small amount. The hose heater has a greater capability of heat transfer, and the manifold heater the greatest of the three heaters.

One basic advantage of the invention is that the temperature which is most important to control (the temperature of the dispensed adhesive) is used to influence the operation of both the upstream hose heater and the manifold heater, which have a greater heat transfer capability, in a series, or cascade, arrangement. By cascading the dispenser adhesive temperature error signal back to the hose and manifold temperature control loops, and by coupling the hose adhesive temperature error back to the manifold temperature control loop, the hose and gun heaters may operate consistently at a percentage power point (nominally 50% of full power) regardless of the particular heat transfer capabilities of the dispenser and hose heaters. This is possible since the larger capacity manifold heater is employed, responsive to both gun and hose adhesive temperature errors, to heat the adhesive in the manifold at a greater rate than that merely called for by the temperature of the adhesive in the manifold; and the hose heater is employed, responsive to gun temperature errors, to heat the adhesive in the hose at a greater rate than that called for by the temperature of the adhesive in the hose.

In the illustrated controlled temperature hot melt adhesive dispensing system, having cascaded temperature control loops, the cascading of temperature errors is preferably deactivated when the dispenser is turned off for a length of time. This prevents the undesirable feedback of temperature error signals which might arise due to slight fixed offsets in the setpoint temperatures of the hose and the gun heeater control loops.

Figure 2A:
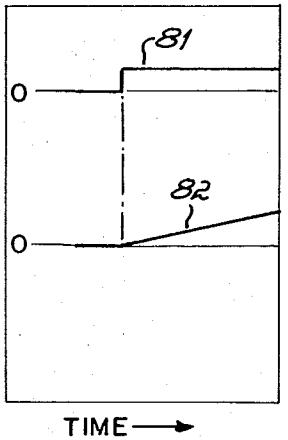
Figure 2B:
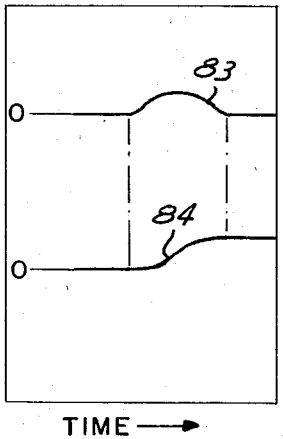
Figure 2C:
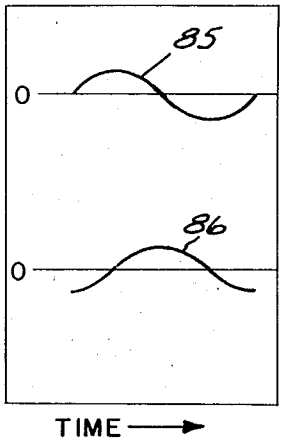

Other advantages of the invention will become apparent upon reading the following detailed description and upon reference to the drawings, in which:

FIG. 1 is a diagrammatic illustration of a controlled temperature hot melt adhesive dispensing system in accordance with the present invention; and FIGS. 2A, 2B and 2C illustrate the forms of the feedback response, between control loops, in the system of FIG. 1 for several forms of temperature error signals.

While the invention is susceptible to various modifications and alternative forms, a specific embodiment thereof has been shown by way of example in the drawings and will herein be described in detail. It should be understood, however, that it is not intended to limit the invention to the particular form disclosed but, on the contrary, the intention is to cover all modifications, equivalents, and alternatives falling within the spirit and scope of the invention as defined by the appended claims.

With reference now to FIG. 1, an exemplary hot melt adhesive dispensing system 11 includes a melting tank 12 for holding the supply of hot melt adhesive and a heated dispenser, or gun, 13 for dispensing hot melt adhesive supplied from the tank 12. The hot melt adhesive, in a suitable molten condition, is supplied to the dispenser 13 through a heated hose 14, and the adhesive is dispensed through a nozzle 16 of the dispenser. The hot melt adhesive is supplied from the tank 12 to the hose 14 and the dispenser 13, under the influence of a pump 17, from a pump manifold 18.

The manifold 18 includes a heater 19 for heating adhesive in the manifold. The manifold 18 is typically formed from a thermally conductive material such as metal and serves to enhance the heat transfer from the heater 19 to the adhesive in the manifold. The hose 14 includes a heater 21, preferably extending substantially the length of the hose (and illustrated schematically in FIG. 1), and the dispenser 13 includes a heater 22. The dispenser 13, like the manifold 18, is preferably thermally conductive to enhance heat transfer from the heater 22 to the adhesive in the dispenser. In the illustrated system, the heat transfer capability of the heater 19 and the manifold 18 is the greatest of the three heater systems in the hot melt adhesive dispensing system 11. The heat transfer capability of the heater 22 and the dispenser 13 is less than that of the heater 21 in the hose 14.

In order to sense the temperature of the adhesive at each of the three adhesive heating locations in the adhesive flow path, three temperature sensors are provided. A temperature sensor 23 is located in the manifold 18, a temperature sensor 24 is placed in the hose 14, and a temperature sensor 26 is located in the dispenser 13.

The dispenser heater 22 and the temperature sensor 26 cooperate with a first heater controller 27 to form a first closed loop temperature control arrangement. The hose heater 21 and the temperature sensor 24 cooperate with a second heater controller 28 to form a second closed loop temperature control arrangement, and the manifold heater 19 and the temperature sensor 23 cooperate with a third heater controller 29 to form a third closed loop temperature control arrangement.

As thus far described, each of the heater controllers 27–29 cooperates with its associated heater and temperature sensor to tend to maintain the temperature of the adhesive at each of the three locations in the adhesive flow path at a setpoint temperature. Each setpoint temperature may be the same as the other setpoint temperatures.

The heater controller 27 for the dispenser 13, for example, includes a comparator 31 which compares a sensed temperature signal, on a line 32 from the temperature sensor 26, with a setpoint temperature signal on an input line 33. The output 34 of the comparator 31 is coupled to a proportional controller 36, which energizes the heater 22 via suitable power leads 37. The proportional controller 36 may take a variety of forms, but in substance supplies an amount of power (between zero and full power) to the heater 22 dependent upon the value of the output 34 of the comparator 31. The proportional controller 36 may be responsive to the output 34 of the comparator 31 such that if the sensed temperature exceeds the setpoint temperature, no power is coupled to the heater. The proportional controller 36 would then provide an increasing proportion of full power to the heater 22 for increased amounts by which the setpoint temperature exceeds the sensed temperature, up to the full activation of the heater 22.

The heater controller 28 for the hose 14 includes a comparator 38 which compares a sensed temperature signal, on a line 39 from the temperature sensor 24, with a setpoint temperature signal on an input line 54. The output 56 of the comparator 38 is coupled to a proportional controller 41, which energizes the heater 21 via suitable power leads 42.

The heater controller 29 for the manifold 18 includes a comparator 43 which compares a sensed temperature signal, on a line 46 from the temperature sensor 23, with a setpoint temperature signal on an input line 61. The output 62 of the comparator 43 is coupled to a proportional controller 44, which energizes the heater 19 via suitable power leads 47.

The first heater controller 27, for the dispenser 13, provides closed loop servo control of the heating of adhesive in the dispenser. In order to take advantage of the greater heat transfer capabilities of the upstream heaters 21 and 19, the output 34 of the comparator 31 in the heater controller 27 not only serves as the input to the proportional controller 36 but also is coupled, in cascade, upstream to the heater controller 28 for the hose 14 and to the heater controller 29 for the manifold 18.

To do this, the comparator output 34 is coupled to an integrator 51 which produces a time integral of the comparator output, and scales this output, to produce a first feedback signal at an output 52, which is coupled to the heater controller 28. This feedback output 52 is algebraically summed with a setpoint input 53 for the heater controller 28 to provide an adjusted setpoint input 54 to the comparator 38. If the time integral output 52 is negative, it is subtracted from the setpoint 53, and if the time integral output 52 is positive, it is added to the setpoint signal 53.

In operation, if the temperature sensed at the dispenser 13 is lower than the setpoint temperature for the heater controller 27, assuming a zero initial condition for the comparator output 34, the output 34 rises, producing a positive output signal at the feedback signal output 52 of the integrator 51. This positive feedback signal is added to the setpoint temperature signal 53, and the adjusted setpoint 54 for the comparator 38 (in the hose heater controller 28) increases. This increase in the signal 54 has the same effect on the output 56 of the comparator 38 as a decrease in the sensed temperature signal 39. Consequently, the comparator 38 output 56 results in the proportional control 41 increasing the energization of the hose heater 21, so that the hose heater is in part responsive to the drop in the sensed temperature at the dispenser 13.

Therefore, for a given setpoint input 53, the output 56 of the comparator 38 in the hose heater controller 28 can increase if either the sensed hose temperature signal 39 decreases or if the time integral feedback output 52 from the integrator 51 increases.

The output 56 of the comparator 38 in the hose heater controller 28 is not only coupled to the proportional control 41 but also to an integrator 57, similar to the integrator 51, which time integrates and scales the comparator output 56. The output 58 of the integrator 57 is algebraically summed with a setpoint temperature signal at an input 59 in the manifold heater controller 29 to produce an adjusted setpoint temperature input 61, which is coupled to the comparator 43. The comparator 43 functions, in the same manner as the comparator 38, to compare a sensed manifold temperature signal 46 with the adjusted setpoint temperature signal 61 to produce an output 62, for the proportional controller 44, which controls the energization level of the manifold heater 19. For a given setpoint input 59, the output 62 of the comparator 43 increases, to increase the energization of the manifold heater 19, in response to a decrease in the manifold sensed temperature signal 46 or an increase in the output signal 58 from the integrator 57. The output 58 of the integrator 57 is in turn dependent upon the time integral of the output 56 of the comparator 38 in the manifold heater controller 28, which is itself influenced by the sensed temperature signals 39 and 32 as earlier discussed.

The interconnection of the heater controllers 27, 28 and 29 by the integrators 51 and 57 serves to cascade the temperature error signals at the output of the comparators 31 and 38 in an upstream direction to take advantage of the increased heat transfer capabilities of the heaters 21 and 19 to correct errors in the adhesive temperature at the dispenser 13.

In FIGS. 2A–2C, the forms of output waveforms for a typical integrator, such as at the output 52 of the integrator 51, in response to three exemplary input waveforms, such as at the integrator input 34, are illustrated. As shown in FIG. 2A, in response to a step input 81 to the integrator 51, a linear sloped response 82 at the integrator output is produced. In FIG. 2B, for a limited duration positive excursion 83 of the input signal 34, the response 84 of the integrator assumes a new, higher value and stays at that value. In FIG. 2C, with a sinusoidal signal 85 at the input 34 to the integrator 51, the integrator output is a negative cosine signal 86.

In order to prevent the adjustment of the setpoint signals 53 and 59 when the dispenser 13 is not dispensing adhesive, and hence when the adhesive flow is stopped, the integrators 51 and 57 are deactivated, or disconnected from the heater controllers 27–29 during no flow conditions. In order to do this, a flow sensor 66 in the adhesive flow path has an output 67 coupled to a flow detector circuit 68. The flow sensor 66 may be, for example, a dispenser pressure sensor. The flow detector circuit 68 is responsive to an increase in pressure in the adhesive flow path which occurs when the gun 13 is deactivated and adhesive flow through the nozzle 16 is turned off. In practice, the flow detector circuit 68 should include a timer to determine when the length of time of deactivation of the gun 13 exceeds an expected length of time of deactivation of the gun occurring during normal intermittent operation of the gun.

The flow detector circuit 68 is coupled to the integrators 57 and 51 by output lines 69 and 71, by which the flow detector is operable to deactivate or disconnect the integrators when the flow sensor 66 indicates a no flow condition for the adhesive in the adhesive flow path of the hot melt adhesive dispensing system 11.

While only a single, presently preferred embodiment of the invention has been described, it may be appreciated that numerous changes and modifications may be made without departing from the spirit of the invention. For example, the exact nature of the feedback elements 51 and 57, which in the illustrated form of the invention are scaling integrators, may operate in other control modes. The feedback elements 51 and 57 may function, for instance, as not only integrating, or reset, feedback elements but also in a rate, or derivative, feedback mode.

It would also be possible to implement the three heater controllers 27–29 and integrators 51 and 57, as well as the flow detector 68, in the form of a programmed computer for microprocessor. In this case, the functions of the controllers, integrators, and flow detector 68 would be implemented in subroutines in the computer or microprocessor-based control system.

What is claimed is:

1. A controlled temperature fluid dispensing system comprising:

a flow path for fluid from an upstream fluid source to a downstream fluid dispenser;

a first closed loop temperature control arrangement for a first location along the flow path including a first heater for fluid in the flow path, a first temperature sensor for sensing the temperature of fluid in the flow path, and a first heater controller, coupled to the first heater and to the first temperature sensor, for comparing, in a first comparison, the temperature sensed by the first temperature sensor with a first setpoint temperature and for controlling the activation of the first heater based upon the result of said first comparison to tend to maintain the temperature sensed by the first temperature sensor at the first setpoint temperature;

a second closed loop temperature control arrangement for a second location, upstream from the first location, along the flow path including a second heater for fluid in the flow path, a second temperature sensor for sensing the temperature of fluid in the flow path, and a second heater controller, coupled to the second heater and to the second temperature sensor, for comparing, in a second comparison, the temperature sensed by the second temperature sensor with a second setpoint temperature and for controlling the activation of the second heater based upon the result of said second comparison to tend to maintain the temperature sensed by the second temperature sensor at the second setpoint temperature;

a third closed loop temperature control arrangement for a third location, upstream from the first and second location, along the flow path including a third heater for fluid in the flow path, a third temperature sensor for sensing the temperature of fluid in the flow path, and a third heater controller, coupled to the third heater and to the third temperature sensor, for comparing, in a third comparison, the temperature sensed by the third temperature sensor with a third setpoint temperature and for controlling the activation of the third heater based upon the result of said third comparison to tend to maintain the temperature sensed by the third temperature sensor at the third setpoint temperature;

first feedback means coupled between the first heater controller and the second heater controller, for adjusting one of (a) the temperature sensed by the second temperature sensor, (b) the second setpoint temperature, and (c) the result of said second comparison, to produce an adjusted second comparison result used by the second heater controller for controlling the activation of the second heater; and second feedback means, coupled between the second heater controller and the third heater controller, for adjusting one of (a) the temperature sensed by the third temperature sensor, (b) the third setpoint temperature, and (c) the result of said third comparison, to produce an adjusted third comparison result used by the third heater controller for controlling the activation of the third heater.

2. A controlled temperature hot melt adhesive dispensing system comprising:

a flow path for hot melt adhesive from an upstream adhesive source to a downstream adhesive dispenser;

a first closed loop temperature control arrangement for the adhesive dispenser including a first heater for adhesive in the dispenser, a first temperature sensor for sensing the temperature of adhesive in the dispenser, and a first heater controller, coupled to the first heater and to the first temperature sensor, for comparing, in a first comparison, the temperature sensed by the first temperature sensor with a first setpoint temperature and for controlling the activation of the first heater based upon the result of said first comparison to tend to maintain the temperature sensed by the first temperature sensor at the first setpoint temperature;

a second closed loop temperature control arrangement for a second location, upstream from the first location, along the flow path including a second heater for adhesive in the flow path, a second temperature sensor for sensing the temperature of adhesive in the flow path, and a second heater controller, coupled to the second heater and to the second temperature sensor, for comparing, in a second comparison, the temperature sensed by the second temperature sensor with a second setpoint temperature and for controlling the activation of the second heater based upon the result of said second comparison to tend to maintain the temperature sensed by the second temperature sensor at the second setpoint temperature;

a third closed loop temperature control arrangement for a third location, upstream from the first and second locations, along the flow path including a third heater for adhesive in the flow path, a third temperature sensor for sensing the temperature of adhesive in the flow path, and a third heater controller, coupled to the third heater and to the third temperature sensor, for comparing, in a third comparison, the temperature sensed by the third temperature sensor with a third setpoint temperature and for controlling the activation of the third heater based upon the result of said third comparison to tend to maintain the temperature sensed by the third temperature sensor at the third setpoint temperature;

first feedback means, coupled between the first heater controller and the second heater controller, for adjusting the second setpoint temperature to produce an adjusted second comparison result used by the second heater controller for controlling the activation of the second heater; and second feedback means, coupled between the second heater controller and the third heater controller, for adjusting the third setpoint temperature to produce an adjusted third comparison result used by the third heater controller for controlling the activation of the third heater.

3. The system of claim 2 in which the flow path includes a pump manifold coupled to an adhesive source and a hose coupled between the manifold and the adhesive dispenser, the first location along the flow path being at the adhesive dispenser, the second location at the flow path being along the hose and the third location along the flow path being at the manifold.

4. The system of claim 2 in which the first feedback means includes means for scaling and integrating the result of said first comparison to produce an adjustment for the second setpoint temperature and the second feedback means includes means for scaling and integrating the result of said second comparison to produce an adjustment for the third setpoint temperature.

* * * * *